US005803764A

United States Patent [19]

Ness

[11] Patent Number: 5,803,764

[45] Date of Patent: Sep. 8, 1998

[54] METHOD OF WEATHER PROOFING AN OPENING THROUGH WHICH AN ELECTRICAL CORD PASSES, AND ASSOCIATED APPARATUS

[75] Inventor: Randolph Peter Ness, Edmonton, Canada

[73] Assignee: The Reel-Thing Innovations Inc., Alberta, Canada

[21] Appl. No.: 773,107

[22] Filed: Dec. 26, 1996

[51] Int. Cl.[6] ..... H01R 13/72

[52] U.S. Cl. ..... 439/501

[58] Field of Search ..... 439/501, 4, 528

[56] References Cited

U.S. PATENT DOCUMENTS

| | | | |
|---|---|---|---|
| D. 226,165 | 1/1973 | Miller | D8/220 |
| D. 275,263 | 8/1984 | Cutler | D8/358 |
| D. 316,666 | 5/1991 | Ishimaru | D8/358 |
| D. 329,637 | 9/1992 | Sutton | D13/140 |
| 447,889 | 3/1891 | Matteson | 191/12.2 R |
| 1,139,554 | 5/1915 | MacLean | 191/12.2 R |
| 1,288,511 | 12/1918 | Clarke | 191/12.2 R |
| 1,626,376 | 4/1927 | Anderson | 191/12.2 R |
| 2,729,797 | 1/1956 | Kobler et al. | 439/528 X |
| 2,745,912 | 5/1956 | Meyer | 191/12.2 R |
| 3,296,387 | 1/1967 | Baigue | 191/12.4 |
| 3,773,969 | 11/1973 | Geisel | 439/528 X |
| 4,095,871 | 6/1978 | Holte | 191/12.4 X |
| 4,656,320 | 4/1987 | Maddock | 191/12.4 |
| 4,844,359 | 7/1989 | Kato | 242/54 R |
| 4,946,010 | 8/1990 | DiBono | 191/12.2 R |
| 5,129,828 | 7/1992 | Bass | 191/12.2 R X |
| 5,494,446 | 2/1996 | DeLucia et al. | 439/501 X |
| 5,535,960 | 7/1996 | Skowronski | 242/378.4 |

FOREIGN PATENT DOCUMENTS

| | | | |
|---|---|---|---|
| 881145 | 11/1961 | United Kingdom | 191/12.4 |

*Primary Examiner*—Neil Abrams
*Assistant Examiner*—Daniel Wittels
*Attorney, Agent, or Firm*—Anthony R. Lambert

[57] ABSTRACT

A method of weather proofing an opening through which an electrical cord passes. The method involves modifying the electrical cord by the addition of an elongate resilient deformable truncated conical sealing element. The electrical cord extends through a longitudinal passage in the truncated conical sealing element. The truncated conical sealing element is received into the opening in interference fit relation to provide a weather seal. The truncated conical sealing element can be integrally moulded to form part of an electrical plug. The opening may be modified with trumpet bell form lips to further enhance the weather seal.

5 Claims, 3 Drawing Sheets

METHOD OF WEATHER PROOFING AN OPENING THROUGH WHICH AN ELECTRICAL CORD PASSES, AND ASSOCIATED APPARATUS

FIELD OF THE INVENTION

The present invention relates to a method of weather proofing an opening through which an electrical cord passes.

BACKGROUND OF THE INVENTION

There are various applications in which an electrical cord is passed through an opening. In a building, an electrical cord may be extended through an opening in a wall in order to provide electrical power to an appliance located outside of the building. One example of such an appliance is an electrically powered sign mounted on the exterior of the building. In a product, an electrical cord may be extended through an opening in a housing. One example of such a product is a cord reel intended to be mounted on a motor vehicle in order to provide power to a block heater in the motor vehicle.

Regardless of the application, weather proofing the opening through which the electrical cord passes is always a problem. When the electrical cord passes through the wall of the building, a driving rain results in water passing through the opening into the building. When the electrical cord passes through the housing of the cord reel mounted on the motor vehicle, driving through puddles results in water splashing against the housing and passing through the opening into the housing.

SUMMARY OF THE INVENTION

What is required is an effective method of weather proofing an opening through which an electrical cord passes.

According to one aspect of the present invention there is provided a method of weather proofing an opening through which an electrical cord passes. A first step involves providing an elongate resilient deformable truncated conical sealing element having a longitudinal passage. A second step involves extending the electrical cord through the longitudinal passage of the truncated conical sealing element. A third step involves securing the truncated conical sealing element to the electrical cord in a manner that precludes liquid passing through the longitudinal passage. The fourth step involves inserting the truncated conical sealing element into the opening through which the electrical cord passes, the truncated conical sealing element engaging the opening in interference fit relation.

With the method, as described above, the truncated conical sealing element positioned in interference fit relation in the opening precludes the passage of water through the opening. The truncated conical sealing element may be placed anywhere along the length of the electrical cord. The truncated conical sealing element was first developed for use with cord reels. In that particular application, it is preferred that the truncated conical sealing element be positioned on the electrical cord adjacent to a base of an electrical plug. When the motor vehicle is in motion the electrical cord is always in a retracted position. In the retracted position, the electrical plug is always positioned adjacent the opening, hence the preferred positioning of the truncated conical sealing element. In such applications, it is advantageous to have the truncated conical sealing element integrally moulded into a base of the electrical plug.

Although beneficial results may be obtained through the use of the method, as described above, sealing of the truncated conical sealing element can be further enhanced by modifying the shape of the opening. The preferred shape of opening has trumpet bell form lips. In addition to providing superior sealing, this shape of opening permits the electrical cord to be pulled at a substantially 90 degree angle in relation to the opening with minimal wear.

According to another aspect of the present invention there is provided an electrical plug which includes a body having an interior cavity, a first end and a second end. An electrical connector element is positioned at the first end. An elongate resilient deformable truncated conical sealing element is positioned at the second end. The truncated conical sealing element has a longitudinal passage which communicates with the interior cavity. This aspect of the invention is a form of electrical plug that has been modified to include a truncated conical sealing element in accordance with the teachings of the method.

According to another aspect of the present invention there is provided an electrical cord which includes a length of insulated wire having a first end and a second end. A male electrical plug is positioned at the first end of the insulated wire. A female electrical plug is positioned at the second end of the insulated wire. An elongate resilient deformable truncated conical sealing element is positioned on the length of insulated wire. The insulated wire passes through a longitudinal passage of the truncated conical sealing element. The truncated conical sealing element is secured to the electrical cord in a manner that precludes liquid passing along the longitudinal passage.

According to another aspect of the present invention there is provided in combination an opening having trumpet bell form lips and an electrical cord. The electrical cord extends through the opening. The electrical cord includes a length of insulated wire having a first end and a second end. A male electrical plug is positioned at the first end of the insulated wire. A female electrical plug is positioned at the second end of the insulated wire. An elongate resilient deformable truncated conical sealing element is positioned on the length of insulated wire. The insulated wire passes through a longitudinal passage in the truncated conical sealing element. The truncated conical sealing element is secured to the electrical cord in a manner that precludes liquid passing along the longitudinal passage. The truncated conical sealing element is positioned in the opening through which the electrical cord passes, engaging the opening in interference fit relation.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method of weather proofing an opening through which an electrical cord passes will now be described with reference to FIGS. 1 through 6.

Figure 1:
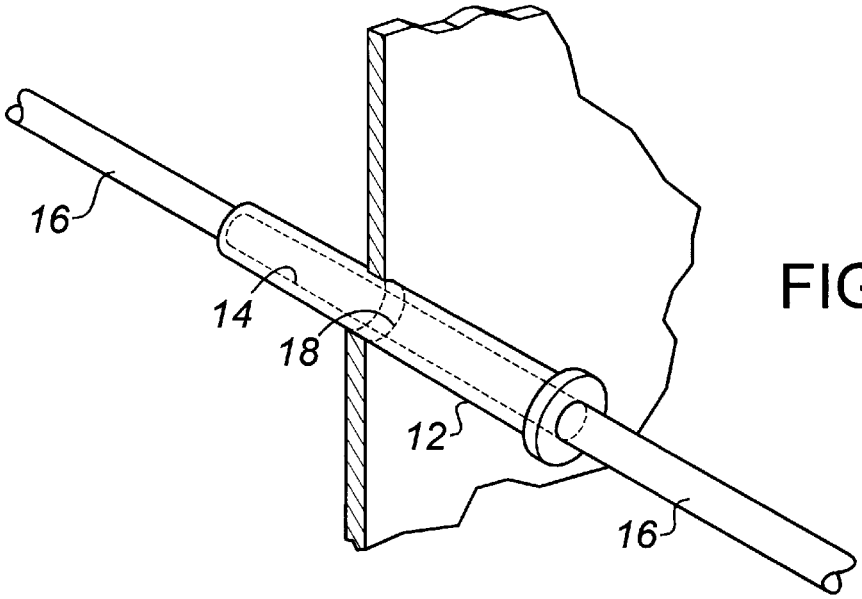
FIG. 1 is a side elevation view of a truncated conical sealing element constructed in accordance with the teachings of the present invention, positioned within an opening.

Referring to FIG. 1, the preferred method involves the following steps. The first step involves providing an elongate resilient deformable truncated conical sealing element 12. It is envisaged that truncated conical sealing element be made from rubber or a plastic with resilient properties. Truncated conical sealing element 12 has a longitudinal passage 14. The second step involves extending an electrical cord 16 through longitudinal passage 14 of truncated conical sealing element 12. The third step involves securing truncated conical sealing element 12 to electrical cord 16 in a desired position. Truncated conical sealing element must be secured in a manner that precludes liquid passing through longitudinal passage 14. It is intended that this be accomplished through an interference fit, although the same result may be obtained through the use of industrial grade epoxy. The fourth step involves inserting truncated conical sealing element 12 into an opening 18 through which electrical cord 16 must pass truncated conical sealing element 12 engages opening 18 in interference fit relation, thereby weather proofing opening 18 by precluding the entry of water.

Figure 2:
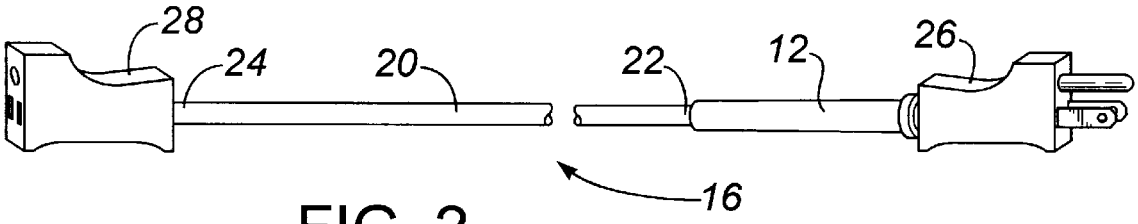
FIG. 2 is a side elevation view of an electrical cord that has been modified in accordance with the teachings of the present invention.

Once the teachings of the present method are understood, it is possible to modify various existing products in order to better practise the method. Referring to FIG. 2, there is illustrated electrical cord 16, which has been modified by the addition of truncated conical sealing element 12. Electrical cord 16 includes a length of insulated wire 20 having a first end 22 and a second end 24. A male electrical plug 26 is positioned at first end 22. A female electrical plug 28 is positioned at second end 24. Truncated conical sealing element 12 is illustrated in a position that is preferred with respect to electrical cords that are intended to be retracted into a cord reel housing. That position is adjacent to an electrical plug and, more particularly, male electrical plug 26.

Figure 3:
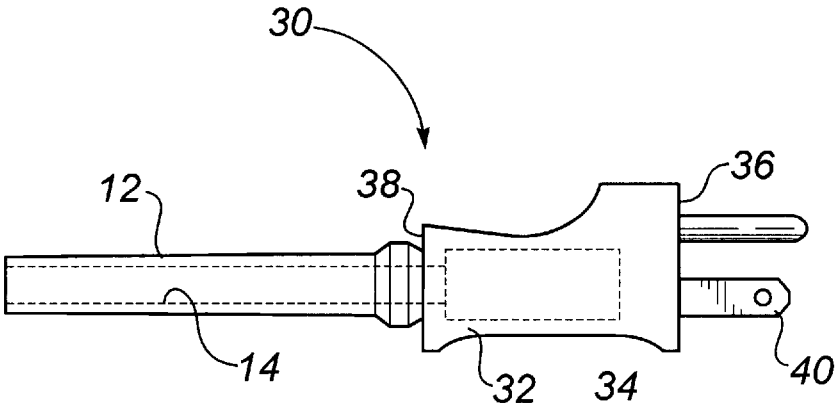
FIG. 3 is a side elevation view of an electrical plug that has been modified in accordance with the teachings of the present invention.

Referring to FIG. 3, there is illustrated an electrical plug 30, in this case a male electrical plug. Male electrical plug 30 includes a body 32 having an interior cavity 34, a first end 36 and a second end 38. An electrical connector element 40 is positioned at first end 36. Truncated conical sealing element 12 is positioned at second end 38. Longitudinal passage 14 of truncated conical sealing element 12 communicates with interior cavity 34. In order to secure male electrical plug 30 to first end 22 of length of insulated wire 20, first end 22 is extended through longitudinal passage 14 in order to enable an electrical connection to be made in interior cavity 34 with electrical connector element 40.

Figure 4:
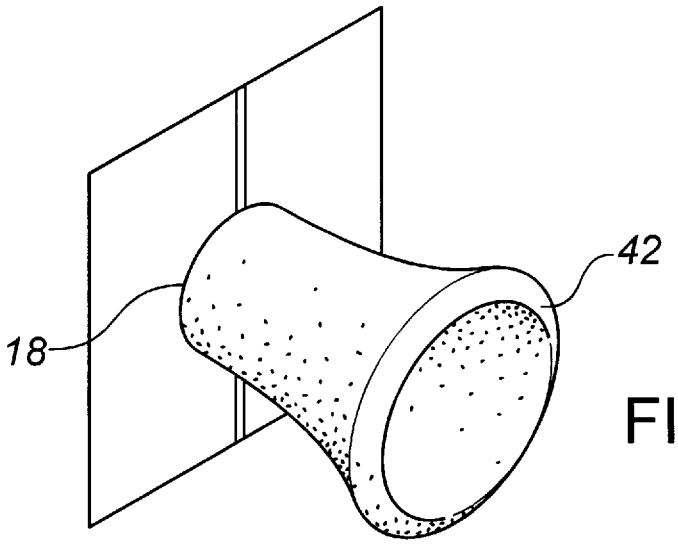
FIG. 4 is a perspective view of an opening that has been modified in accordance with the teachings of the present invention.
Figure 5:
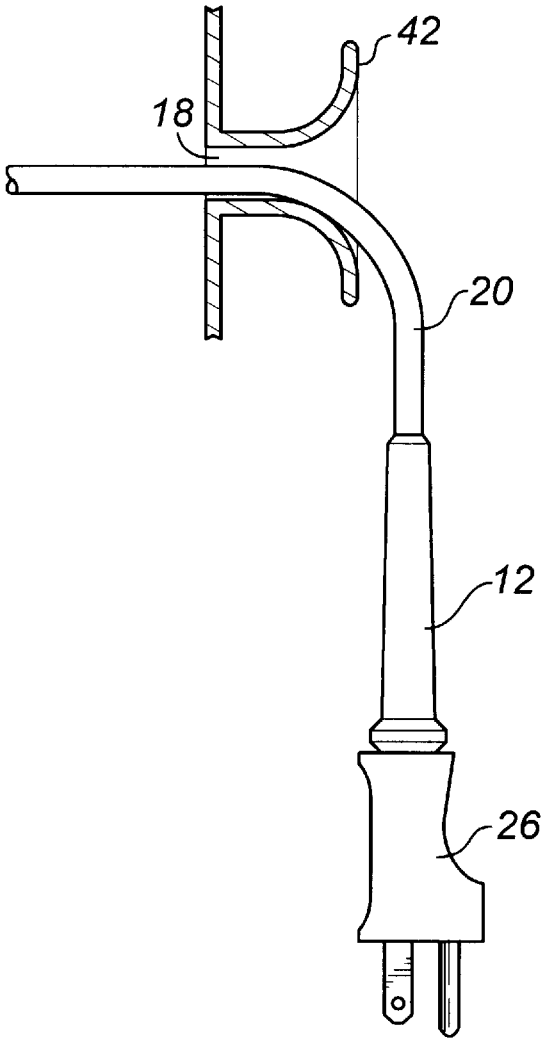
FIG. 5 is a side elevation view of the modified opening illustrated in FIG. 4, with an electrical cord extending through the opening.
Figure 6:
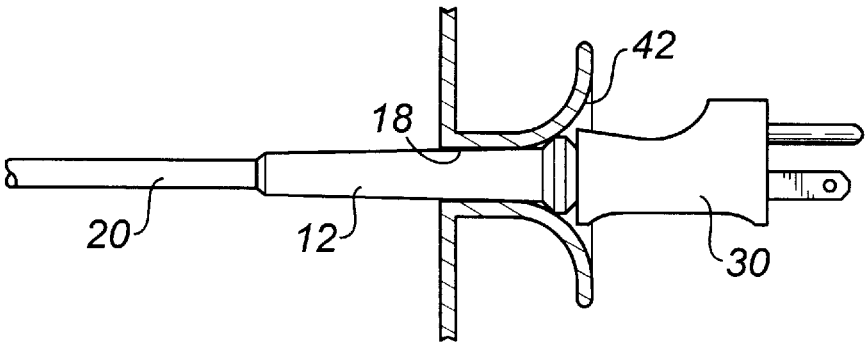
FIG. 6 is a side elevation view of the modified opening illustrated in FIG. 4, in combination with the modified electrical plug illustrated in FIG. 3.

Referring to FIGS. 4 through 6, opening 18 has been modified by the addition of trumpet bell form lips 42. Trumpet bell form lips 42 serve a number of useful functions. Referring to FIG. 5, trumpet bell form lips 42 permits electrical cord 16 to be pulled at a substantially 90 degree angle in relation to opening 18 with minimal wear. Referring to FIG. 6, trumpet bell form lips 42 serve to guide truncated conical sealing element 12 into position in opening 18, and cooperates with truncated conical sealing element 12 to provide a superior seal.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. In combination:

an opening;

an electrical cord extending through the opening, the electrical cord comprising:

a length of insulated wire having a first end and a second end;

a male electrical plug at the first end of the insulated wire;

a female electrical plug at the second end of the insulated wire;

an elongate resilient deformable truncated conical sealing element positioned on the length of insulated wire, with the insulated wire passing through a longitudinal passage of the truncated conical sealing element, the truncated conical sealing element being secured to the electrical cord in a manner that precludes liquid passing along the longitudinal passage;

the truncated conical sealing element being positioned in the opening through which the electrical cord passes, the truncated conical sealing element sealingly engaging the opening in interference fit relation along the entire perimeter of the opening.

2. The combination as defined in claim 1, wherein the truncated conical sealing element is positioned on the electrical cord adjacent to one of the male electrical plug and the female electrical plug.

3. The combination as defined in claim 1, wherein the contact between the truncated conical sealing element and the perimeter of the opening is axially extensive along the length of the opening.

4. In combination:

an opening having trumpet bell form lips;

an electrical cord passing through the opening, the electrical cord including:

a length of insulated wire having a first end and a second end;

a male electrical plug at the first end of the insulated wire;

a female electrical plug at the second end of the insulated wire;

one of the male plug and the female plug having:

a body having an interior cavity, a first end and a second end;

an electrical connector element at the first end;

an elongate resilient deformable truncated conical sealing element at the second end, the truncated conical sealing element having a longitudinal passage communicating with the interior cavity, the truncated conical sealing element being secured to the electrical cord in a manner that precludes liquid passing along the longitudinal passage into the interior cavity;

the truncated conical sealing element being positioned in the opening through which the electrical cord passes, the truncated conical plug sealingly engaging the opening in interference fit relation along the entire perimeter of the opening.

5. The combination as defined in claim 4, wherein the contact between the truncated conical scaling element and the perimeter of the opening is axially extensive along the length of the opening.

* * * * *